United States Patent [19]

Horn

[11] 3,933,114

[45] Jan. 20, 1976

[54] SELF-PURGING TELL-TALE NOZZLE

[75] Inventor: Norman E. Horn, Oshkosh, Wis.

[73] Assignee: Brunswick Corporation, Skokie, Ill.

[22] Filed: Jan. 24, 1975

[21] Appl. No.: 543,918

Related U.S. Application Data

[63] Continuation of Ser. No. 385,821, Aug. 6, 1973, abandoned.

[52] U.S. Cl. ..... 115/17; 115/.5 HC

[51] Int. Cl.[2] ..... B63H 21/26

[58] Field of Search ..... 115/17, 18 R, .5 R; 239/106–108, 534, 602

[56] References Cited

UNITED STATES PATENTS

| | | | |
|---|---|---|---|
| 2,232,160 | 2/1941 | Blu et al. | 115/18 R |
| 2,571,245 | 10/1951 | Holmes et al. | 115/18 R |
| 2,953,248 | 9/1960 | Troland | 239/107 |
| 3,520,270 | 7/1970 | Miller | 115/17 |

FOREIGN PATENTS OR APPLICATIONS

| | | | |
|---|---|---|---|
| 1,309,901 | 10/1961 | France | 239/534 |

*Primary Examiner*—Trygve M. Blix
*Assistant Examiner*—Stuart M. Goldstein
*Attorney, Agent, or Firm*—William G. Lawler, Jr.

[57] ABSTRACT

A resilient rubber self-purging nozzle for the "tell-tale" water line of a water cooled outboard motor. A cone shaped nozzle of soft rubber restricts discharge of tell-tale water stream and expands upon blockage to permit blocking matter to be discharged overboard.

5 Claims, 4 Drawing Figures

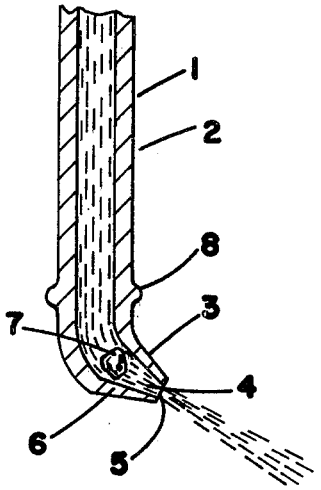
Fig 1
Fig 2
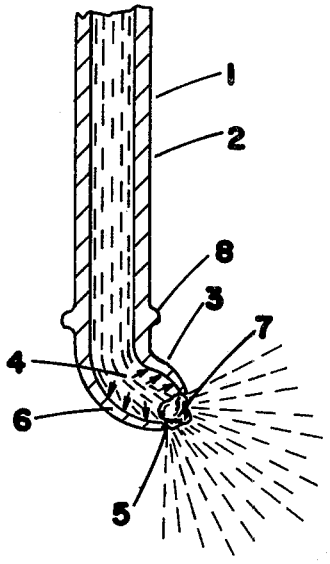
Fig 3
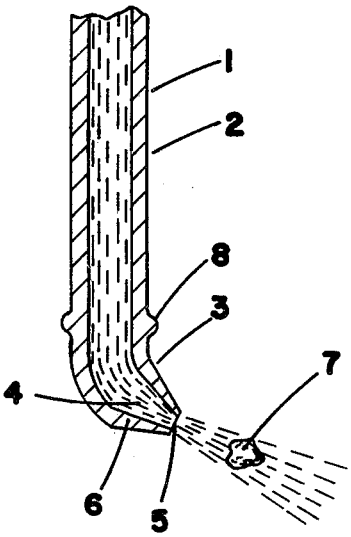

SELF-PURGING TELL-TALE NOZZLE

BACKGROUND OF THE INVENTION

This application is a continuation of Ser. No. 385,821 filed Aug. 6, 1973, now abandoned, entitled "Self-Purging Tell-Tale Nozzle".

Outboard motors driven by two-cycle water cooled powerheads are typically provided with means for discharging a small amount of cooling water from a position on the engine easily observed by the operator. This stream of water tells the operator that his cooling system is working.

The visible stream of water, commonly referred to as the tell-tale, is typically provided by a tube connecting a portion of the engine water jacket with the desired overboard discharge point. Prior to the invention it was common practice to place a metering orifice at the discharge point of the aforementioned tube, which orifice limited the amount of cooling water discharge as the tell-tale.

A perennial problem with the aforementioned prior art tell-tale arrangement was the collection of debris behind the orifice resulting in its blockage. The orifice then had to be removed, which was not always possible, or a small diameter wire or pin repeatedly jammed in the orifice until the blockage was cleared little by little through the orifice and around the pin. When outboard motors so configured were operated in waters contaminated with algae and other flotsam that could be sucked into the water cooling system, plugging of the tell-tale orifice was common and often very troublesome.

It is the objective of the invention to overcome this problem by providing a self-purging orifice for the tell-tale line.

SUMMARY OF THE PRESENT INVENTION

Basically the invention comprises a resilient tell-tale nozzle of a generally funnel shape having side walls which taper toward the open end of the nozzle and there form an orifice of pre-selected dimension. The hardness of the resilient material and the taper of the side wall of the nozzle combine to provide an orifice which will hold its size up to maximum water flow therethrough, and yet sufficiently deform under substantially increased static water pressure to permit passage of blocking elements stuck within the nozzle.

The outstanding advantage of the invention, repeatedly demonstrated in tests, is its ability to purge itself of materials which block the tell-tale line in the area of the resilient nozzle.

A further advantage of the tell-tale nozzle of the invention is its accessibility to massage by the fingers of the operator to loosen and thereby aid in the expulsion of contaminants partially blocking water flow therethrough.

Other objectives, advantages, and various further features of novelty and invention will be pointed out or will occur to those skilled in the art from a reading of the following specification in conjunction with the accompanying drawings.

BRIEF DESCRIPTION OF THE DRAWINGS

FIG. 1 is a cross-sectional view of a tell-tale nozzle of the invention as it would appear under normal operating conditions with a contaminating particle entering the nozzle.

FIG. 2 is a cross-sectional view of the tell-tale nozzle of FIG. 1 as it would appear when blocked by the contaminating particle.

FIG. 3 is a cross-sectional view of the tell-tale nozzle of FIG. 2 immediately following discharge of the contaminating particle.

DETAILED DESCRIPTION OF THE DRAWING

Figure 4:
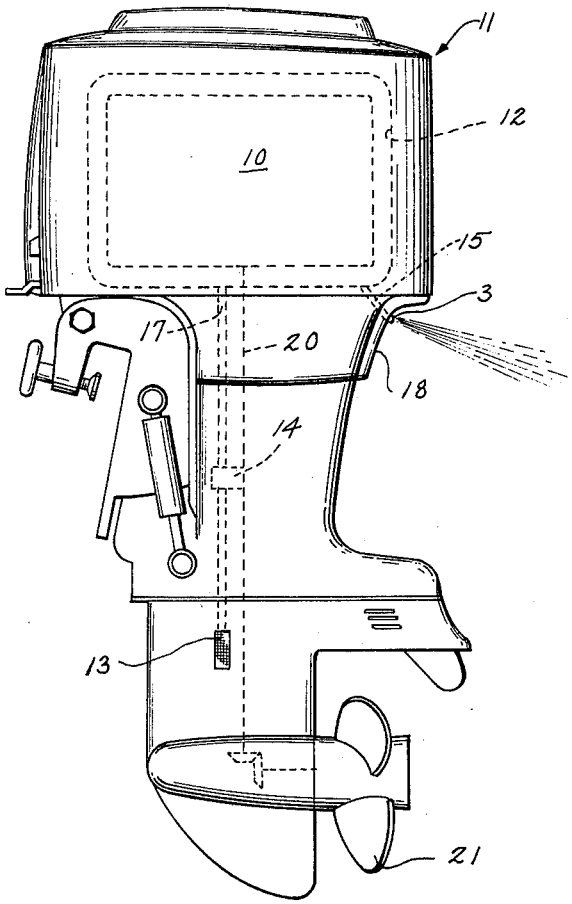
FIG 4 (PRIOR ART)
FIG. 4 is a schematic view of the cooling system of a prior art outboard motor illustrating a tell-tale discharge.

Referring to FIG. 4, it is common practice to surround the powerhead 10 of an outboard motor 11 with a cooling water jacket 12. Water is drawn in through an inlet screen 13 by the action of a water pump 14 driven by the drive shaft 20 connecting the powerhead 10 to the propeller 21. The cooling water is circulated under pressure through an inlet passage 17 to the water jacket 12 by the action of pump 14. A small portion of this cooling water is directed from the water jacket through what is known in the art as a tell-tale water line 15 and discharged overboard through a tell-tale nozzle 3. The remainder of the cooling water may be discharged overboard through the engine exhaust system or through other overboard discharge passages known to the art (not shown and not pertinent to the invention). The nozzle is located above the level of the surrounding water on the engine so that the operator of the engine can observe the tell-tale discharge when the engine is running and be assured that cooling water is circulating through the water jacket 12.

Referring to FIG. 1, a tell-tale overboard discharge fitting 1, such as that illustrated, may be made of any resilient material such as neoprene or nitrile rubber, preferably having a durometer hardness of 40, and a tensile strength of 1200 PSI for long life.

The fitting 2 may be comprised of a tubular body 2 terminating in a restricted area 4 which forms a nozzle 3. The restriced area 4 commences at a point upstream of the orifice 5 a distance equal to approximately three times the diameter of the orifice 5. From this point to the outer extremity of the orifice 5, the side walls 6 of the nozzle 3 taper from a thickness equal to slightly less than the diameter of the orifice 5 to a thickness of approximately one-third the diameter of the orifice 5. The tubular body 2 may comprise, or connect to the tell-tale water line 15 connecting the nozzle 3 to the water jacket 12 of the engine. An annular ridge 8 may be molded on a part of the fitting 1 as a means of holding the fitting 1 in place within the engine cowling 18.

The restricted area 4 of the nozzle commences at the same point upstream of the orifice as the side walls 6 begin to taper. From this point out, the diameter of the restricted area 4 is reduced steadily from the diameter of the water line 2 to the diameter of the orifice 5. For example, where a nitrile rubber having a durometer hardness of 40 is employed, the interior taper of the restricted area 4 may extend over a length of 0.38 inches upstream of the orifice 5 and be reduced from a maximum interior diameter of 0.30 inches to a minimum orifice diameter of 0.12 inches. Over the same distance the thickness of the walls 6 may be reduced from a maximum thickness of 0.10 inches to a minimum of 0.04 inches at the orifice 5.

Referring now to FIG. 2, the operation of the invention will be described. To assure that contaminants will not lodge within the tell-tale water line itself, the tell-tale water line 15 leading to the nozzle 3 is made large enough to easily pass contaminants which may enter the motor cooling system through the intake screen 13. Since the nozzle 3 and orifice 5 constitute the points of maximum restriction within the tell-tale line, blockage will occur in this area. Quite often blockage will commence with the lodging of a small piece of shell or wood within the restricted area 4. Mud, seaweed or algae may collect around this piece of wood or shell gradually restricting the flow of water until the orifice 5 is blocked. At this point, the water pressure within the restricted area 4 changes from that existing under free flow condition to the water pressure existing within the restricted flow of the cooling system. In the preferred embodiment, the tell-tale water line is connected to the output side of the cooling water pump 14 so as to provide maximum pressure for self-purging.

With the orifice blocked by a contaminant 7 as illustrated in FIG. 2, the static water pressure within the tube indicated by the small arrows will gradually expand or balloon the side walls 6 until the blocking material 7 may pass clear through the orifice 5.

A tell-tale configured as above described has operated successfully on an engine wherein the static water pressure within the cooling system was 3–5 PSI at idle, and the flow pressure 25 PSI at full RPM. However, the characteristics of the nozzle 3 must be tailored to the individual engine and water pressure output. This may be accomplished by configuring the orifice 5 and side walls 6 of the restricted area 4, as taught herein, until the following two criteria are met:

1. The orifice 5 will maintain its size under water flow with the engine at maximum RPM, and
2. The side walls 6 of the nozzle 3 are soft enough to permit a steel ball, having a diameter slightly less than the diameter of the tell-tale water supply line 2 tube to be pushed therethrough by the water pressure in the line at, or slightly above, idle speed of the engine.

Experience has indicated that the aforementioned qualities can best be achieved by providing the nozzle 3 with gradually tapered side walls made of soft rubber; however, it is probable that the same self-purging effect and advantages of the invention may be achieved by alternate configurations reached by application of the teachings of the invention. A high tensile strength of the rubber is desired so that the orifice 5 will maintain its shape over a long period of time.

While the principles of the invention have been described in connection with the above specific apparatus, it is to be clearly understood that this description is made only by way of example and not as a limitation to the scope of the invention.

I claim:

1. A marine outboard motor including a powerhead, a cowling enclosing said powerhead, a cooling water jacket generally surrounding said powerhead, water pump means driven by said motor and responsive to the operating speed thereof for supplying said water jacket with cooling water under pressure, and a tell-tale overboard water discharge line, characterized by; a self-purging overboard discharge nozzle for said tell-tale line, said nozzle comprising a self-supporting unbroken conical wall of soft resilient material defining a conical passage tapering in cross section from a wide end to an annular orifice, said conical wall diminishing in thickness from the wide end of said conical passage to said orifice, said wall being sufficiently rigid to maintain the shape and size of said orifice under operating conditions of selected maximum free water flow through said orifice at full engine and water pump speed, and said wall being sufficiently resilient to enable said conical passage to be automatically expanded by the water pressure output of said water pump when said engine is near idle speed and said orifice is blocked to a diameter substantially equal to that of said tell-tale overboard discharge line so as to permit the blocking matter to pass therethrough.

2. The device of claim 1 wherein the thickness of said conical wall diminishes from a thickness substantially equal to the diameter of the orifice to a thickness substantially equal to one-third the diameter of the orifice.

3. The device of claim 2 wherein such conical passage has a length equal to substantially three times the diameter of said orifice.

4. The device of claim 2 wherein said soft resilient material is rubber having a durometer hardness of between 30 and 50.

5. The device of claim 1 further including flange-like means extending radially of said nozzle for retaining said nozzle in position with respect to said cowling.

* * * * *